United States Patent [19]

Kiang

[11] 4,078,841

[45] Mar. 14, 1978

[54] TV CHAIR WITH DOUBLE PILLOW CASE AND TWO-STEP OTTOMAN

[76] Inventor: Piao Kiang, 146, Hsin-I Road, III, Taipei, China /Taiwan

[21] Appl. No.: 671,946

[22] Filed: Mar. 30, 1976

[30] Foreign Application Priority Data

Oct. 29, 1975 South Africa ..... 75/6831

[51] Int. Cl.[2] ..... A47C 1/02

[52] U.S. Cl. ..... 297/68; 297/317; 297/342

[58] Field of Search ..... 297/318, 320, 111, 105, 297/391, 410, 68, 88, 85, 317, 340, 341, 342, 343, 83

[56] References Cited

U.S. PATENT DOCUMENTS

| | | | |
|---|---|---|---|
| 1,301,835 | 4/1919 | Glenister | 297/320 |
| 2,102,979 | 12/1937 | Smith | 297/318 X |
| 2,473,895 | 6/1949 | Mednick | 297/318 |
| 2,725,921 | 12/1955 | Markin | 297/318 X |
| 2,730,423 | 1/1956 | Mock | 312/348 |
| 2,925,122 | 2/1960 | Winick | 297/318 |
| 3,039,821 | 6/1962 | Black et al. | 297/343 |
| 3,578,379 | 5/1971 | Taylor | 297/391 |

FOREIGN PATENT DOCUMENTS

| | | | |
|---|---|---|---|
| 415,992 | 11/1946 | Italy | 297/318 |
| 41,846 | 1/1917 | Sweden | 297/320 |

*Primary Examiner*—James T. McCall

*Attorney, Agent, or Firm*—Cushman, Darby & Cushman

[57] ABSTRACT

A recliner chair having seat and back portions pivotally connected and supported on a frame structure for movement between an upright position and an inclined position with supporting rollers secured to the rear portion of the frame structure and movable along track means secured to the rear of the back portion of the seat; the track means having limiting stops at both ends with a retaining member on the lower end to maintain the seat in the upright position and a limiting stop on the other end to maintain the seat in the reclined position. Also, an ottoman is provided with an upper portion movable between a first and second position which correspond to the level of the outer end of the bottom portion of the seat when it is in the upright and reclining positions. Also a pillow member is provided, movably secured to the back portion of the seat with a counter weight on the opposite side of the seat and slidably contained within a sheath to permit the pillow to be moved to a desired position where it will remain.

9 Claims, 14 Drawing Figures

TV CHAIR WITH DOUBLE PILLOW CASE AND TWO-STEP OTTOMAN

BACKGROUND OF THE INVENTION

1. Field of the Invention

This invention relates to a recliner chair and more particularly, to a reclining chair having two positions.

2. The Prior Art

A multitude of reclining chairs have been invented which use rather complicated mechanism to move the bottom and back portions of the seat member between a plurality of positions. Such devices include complicated lever mechanism and bottom and back portions which are moved independently to new positions in order to accomodate the human form. The more complicated such devices become, the more expensive they are and the more likely they are to break down or be easily damaged so as to make them inoperable.

SUMMARY OF THE INVENTION

The present invention is intended to overcome the disadvantages and difficulties associated with such prior art devices by providing a simple means for moving the seat bottom and back portions between two positions, a sitting position and a reclining position. In the sitting position the seat is so retained that only a slight amount of pressure, appropriately applied, is required to cause the chair to move to the reclining position.

These advantages are accomplished by the present invention by utilizing a simple rigid frame structure and a seat member having back and bottom portions pivotally attached to each other and mounted to the frame structure for movement between an upright sitting position and a reclining position. Rollers are secured to the upper rear portion of each side of the frame and are associated with a corresponding track means attached to each side of the rear of the back portion of the seat; each track means having an upper limiting means which stops the movement of the seat member from going beyond the predetermined inclined position, and the lower end portion of each track means has a limiting means and a retaining means which stops the movement of the seat in the upright position and retains the seat in that position until a force is applied to the seat back or bottom portion which will overcome the retaining means and permit the seat member to move from the upright position to the inclined position. The bottom portion of the seat preferably contains track means on each side thereof which ride on associated rollers attached to the front lower portion of each side of the frame member to permit the seat to move forward and back between the upright and inclined positions. Rollers are also positioned on each side of the seat at the point of pivotal attachment between the back and bottom portions of the seat member and ride on associated track means on the frame member for substantially horizontal movement when the seat is moved from the upright position to the inclined position and vice versa.

An adjustable pillow is attached by a flexible cord or piece of fabric to a counterweight disposed on the rear side of the upper back portion of the seat member within a sheath which permits the counterweight to slide up or down therein and retain the pillow in the desired position.

An ottoman has an upper cushion portion which is movable between up and down positions wherein the upper surface of the cushion member is movable between positions which correspond to the positions of the seat member of the reclining chair so as to provide a comfortable position for the legs of a person sitting in the chair when it is in either the upright position or the reclining position.

DETAILED DESCRIPTION OF THE PREFERRED EMBODIMENT

Figures 1, 2, 3:
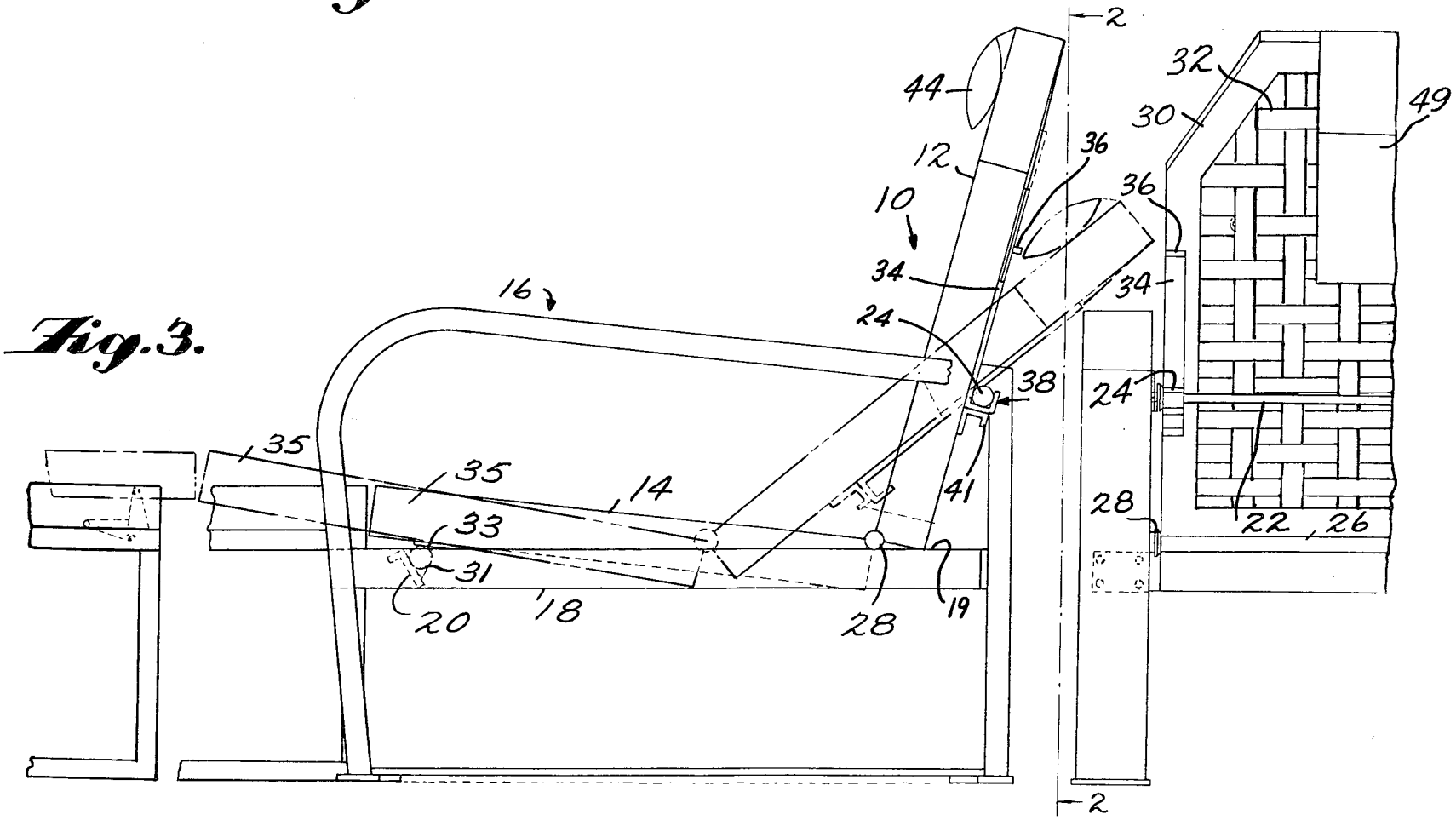
FIG. 1 is a side elevational view of one embodiment of a reclining chair according to the present invention.
FIG. 2 is a rear elevational view of a portion of the recliner chair of FIG. 1.
FIG. 3 shows an ottoman in connection with the adjustable chair of FIG. 1.
Figures 4, 5:
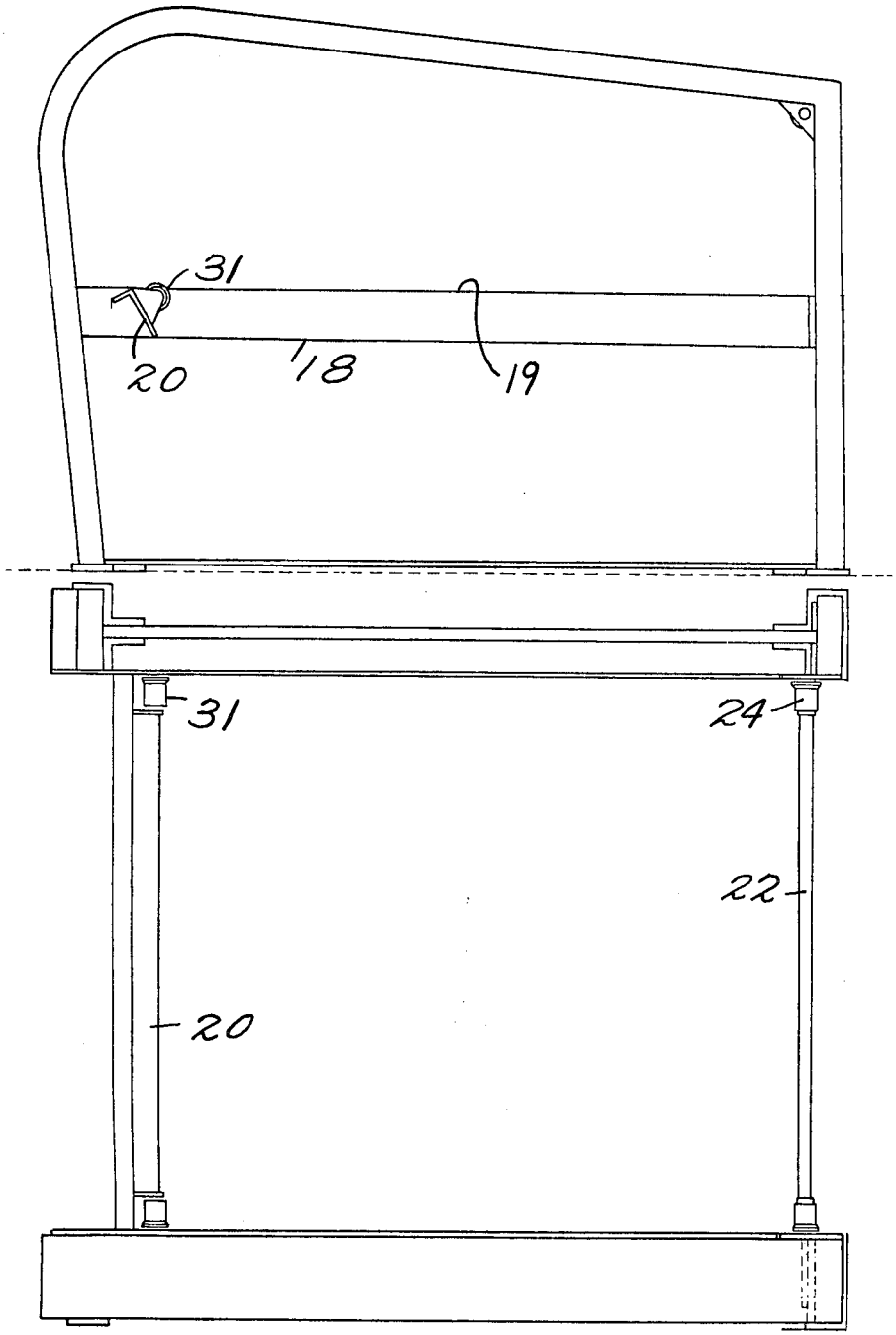
FIG. 4 is a side elevational view of a portion of the rigid frame structure of the chair of FIG. 1.
FIG. 5 is a top plan view of the rigid frame structure of the chair of FIG. 1.

Referring more particularly to FIG. 1, a seat member 10 is provided with a back portion 12 and a bottom portion 14 positioned in a rigid frame structure consisting of a pair of side frames 16, one positioned on each side of the seat member and each having a cross member 18. The cross members 18 are secured together by a front brace member 20, while the rear portion of the frame member 16 are secured together at the upper rear portion thereof by rod 22 which has rollers 24 secured to the ends thereof adjacent each side frame in supporting relation to the back portion 12.

The back portion 12 and bottom portion 14 of seat member 10 are pivotally attached to each other preferably along inner upper adjacent edges of each by any suitable means such as a hinge extending substantially across the seat 10, and having axial rod 26 extending therethrough so as to provide a pivotal axis for the seat back and bottom portions. Coincident with the pivotal axis and attached on each side of the seat member 10 to the ends of rod 26, are rollers 28 which are free to rotate and ride on the upper surface 19 of frame members 18, constituting a substantially horizontal track means for the rollers.

Supporting the bottom portion 14 at the front portion thereof are rollers 31, one of each of which is secured for rotation to each frame cross member 18 beneath the bottom portion 14. Secured to the underside of bottom portion 14 are track means 33, one of each of which is associated with a corresponding roller 31 for supportive movement thereon. When the seat member 10 is moved from the upright position to the inclined position, the bottom portion 14 moves from the position shown in solid lines in FIG. 1 to the position shown in phantom, so that the front portion 35 of the seat bottom portion 14 moves forwardly and upwardly to a new height.

Figure 6:
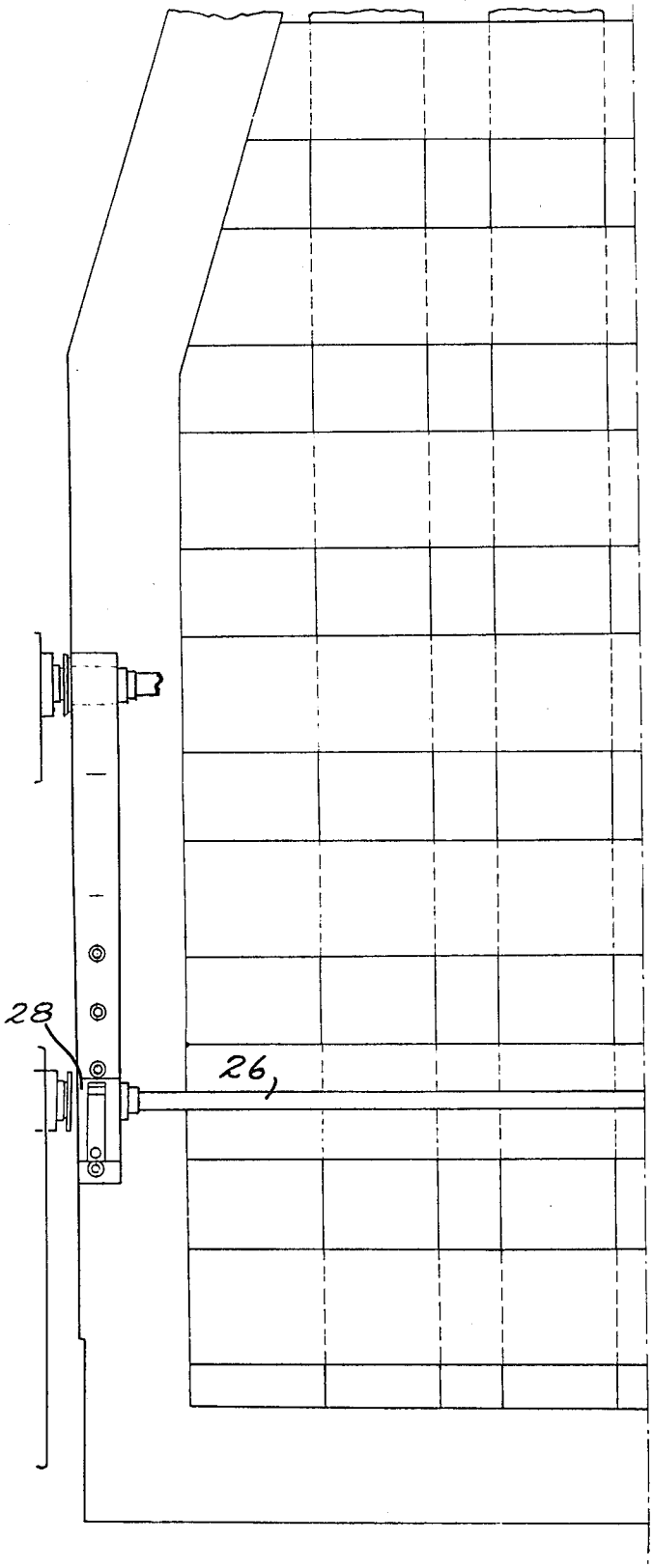
FIG. 6 is a rear elevational view of a portion of the back portion of the chair of FIG. 1.
Figure 8:
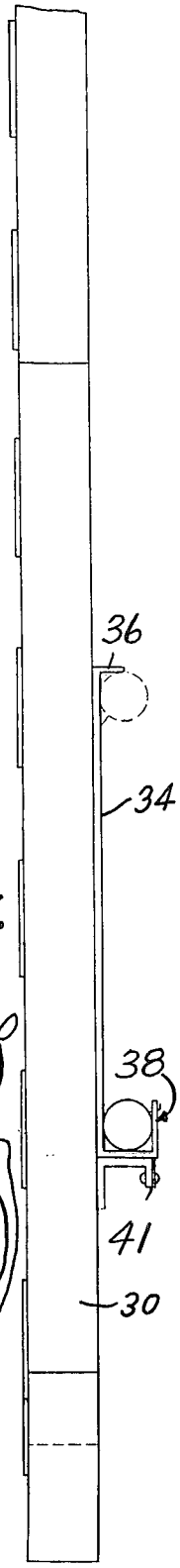
FIG. 8 is a side plan view of the portion of the chair illustrated in FIG. 6.
Figure 7:
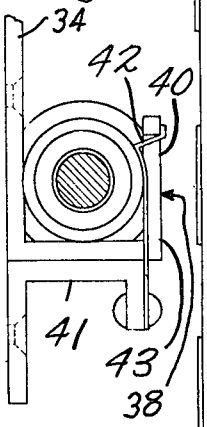
FIG. 7 shows an expanded view in partial cross-section of the track means and retainer associated with the back portion of the chair of FIG. 1.
Figure 11:
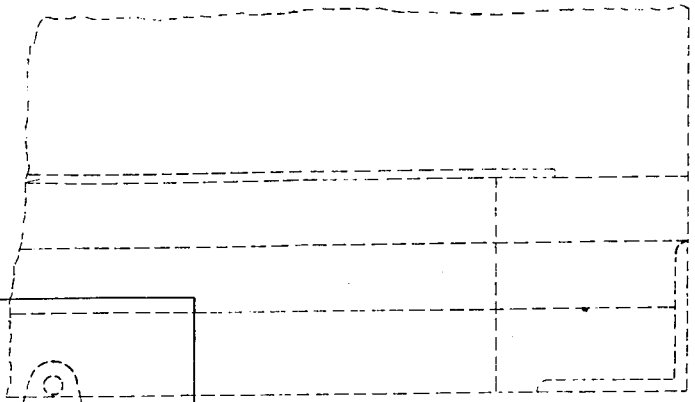
FIG. 11 is a top plan view of the pillow means attached to the chair in FIG. 1.
Figure 12:
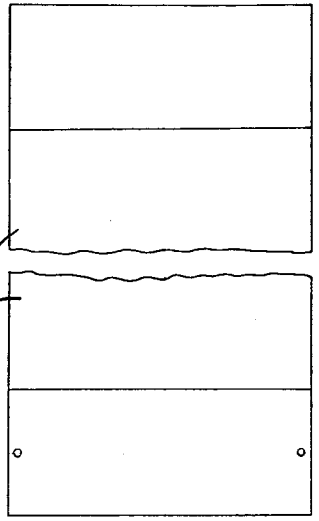
FIG. 12 is a top plan view of the counterweight secured to the pillow means.
Figure 13:
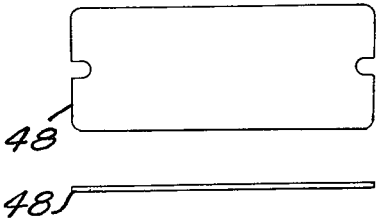
FIG. 13 is a side view of the counterweight illustrated in FIG. 12.
Figure 10:
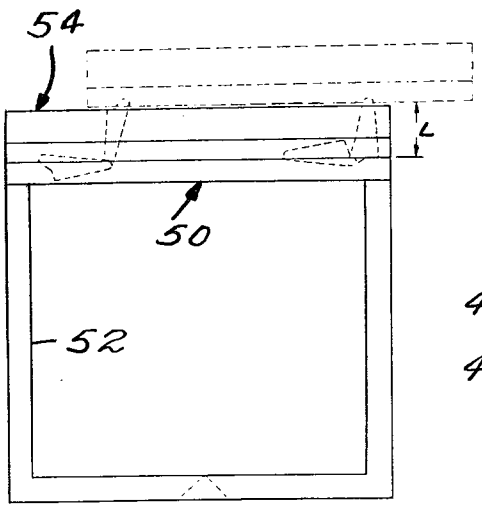
FIG. 10 is a side elevational view of the ottoman illustrated in FIG. 3.

The seat back portion 12 and bottom portion 14 are made up of a frame member 30 and a webbing 32 attached to the frame to provide a cushion on which to set. Actually, any other type of cushion may be utilized with regard to the present invention. Attached to the rear side of frame 30 are track means 34, one being positioned on each side and associated with rollers 24 which ride thereon. At the upper end of each of the track means 34 is a bent portion 36 which extends substantially perpendicular to the track means which constitutes a stopper for roller 24 when the chair is in the inclined position. At the bottom end of each track means 34 is a bent portion forming a U-shaped cross section 38 which constitutes a limiting stop which receives the roller 24 therein when the chair is in the upright position. As best seen in FIGS. 6 and 7, the end 40 of bent portion 38 of each track means 34 has a spring member 42 associated therewith which is secured to another bracket 41 which in turn is secured to the frame member 30 adjacent the bent portion 38, so as to permit the spring member 42 to set in an opening 43 formed in the back of each end 40. The spring members 42 are preferably leaf-springs which are so formed so as to conform to the roller 24 to apply pressure thereto and maintain the roller in position when the seat is in the upright sitting position. The springs are so designed that when a person pushes against the upper portion of back seat portion 12 the rollers 24 will become free of spring members 42 and the track means will move along the rollers until they reach the ends 36, constituting the reclining position for the seat 10.

The pillow 44 is preferably sewn to a rectangular piece of fabric 46 which in turn is secured to the counterweight member 48. When the pillow is draped over the chair the fabric will ride on the upper edge of the seat back portion thereof and the counterweight 48 will be contained within a rectangular cloth sheath 49 attached to the rear portion of the back portion 12. The counterweight 48 is movable within the sheath so that the pillow 44 may be positioned as desired by the user of the chair, but will be maintained in that desired position until moved again. Also, since the counterweight is contained within a sheath, when the recliner chair is in the reclining position the counterweight will be held against the rear of back portion 12 of the seat member 10.

Figure 9:
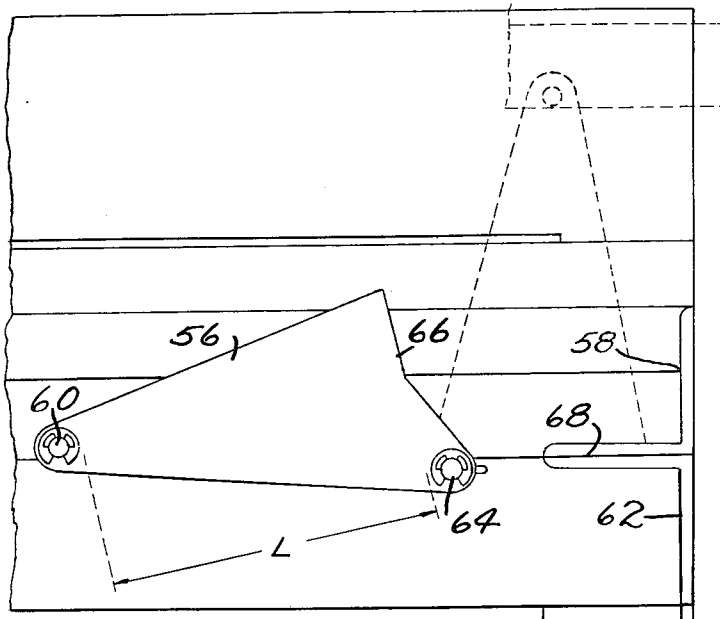
FIG. 9 is an expanded view of a portion of the ottoman illustrated in FIG. 3.
Figure 9A:
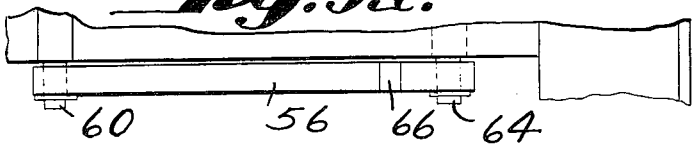
FIG. 9*a* is top plan view of the structure shown in FIG. 9.

The ottoman 50 comprises a cubical frame structure 52 forming legs of the ottoman and providing support for the cushion member 54 on the upper portion thereof when in the lower position. The cushion member 54 is secured to the frame member 52 on opposite sides thereof by a pair of hinge members 56 pivotally attached to the inner side of the frame. The frame 58 which supports the cushion is pivotally secured by pin 60 to the member 56 and the frame member 62 is pivotally secured by pin 64 to the opposite end of member 56. With the four members 56 secured to the ottoman as illustrated, when the cushion portion 54 is in the lower most position the frame 58 will rest on the frame 62, and when the cushion is raised to the upper most position the edge 66 of member 56 will rest on the upper portion 68 of frame member 62 and support the cushion member as shown in phantom in FIG. 9. The lower most position of cushion 54 will correspond to the height of the front end of the bottom portion 14 of seat 10 and the upper most position of cushion 54 corresponds to the front end of the bottom portion 14 of the seat when it is in the inclined position; thus providing support for the users legs at the appropriate level depending upon the position of the seat member and the cushion of the ottoman.

Although the foregoing description illustrates the preferred embodiment of the present invention, it will be apparent to those skilled in the art that variations are possible. All such variations as would be obvious to those skilled in this art are intended to be included within the scope of this invention as defined by the following claims.

What is claimed is:

1. An adjustable recliner chair comprising: a rigid frame structure; a seat member having a bottom and a back portion, movable between an upright position and an inclined position; means mounting the bottom portion to the back portion along adjacent edges thereof for relative pivotal movement therebetween; first roller and track means adapted to support the bottom portion on the frame structure at a forward portion thereof for substantially horizontal translational movement of the bottom portion relative to the frame structure; second roller and track means adapted to support the back portion on the frame structure for movement from an upright position to a reclining position; third roller and track means having a roller mounted on each side of the seat member substantially coincident with the mounting means and a substantially horizontal track mounted on the frame structure upon which the third rollers are supported for movement therealong; first limiting means secured to the back portion at an upper end of the second track means for stopping the movement of the second roller means when the seat member is in the inclined position; second limiting means secured to the back portion adjacent a lower end of the second track means for stopping movement of the second roller means when the seat member is in the upright position; and spring means secured to the lower end of the second track means for releasably retaining the second roller means against the second limiting means, wherein the spring means comprises a leaf spring mounted on the back portion adjacent the lower end of the second track means, the leaf spring having a bent end portion engageable with the roller means so as to releasably retain the roller means against the second limiting means.

2. An adjustable recliner chair comprising: a rigid frame structure; a seat member having a bottom and a back portion, movable between an upright position and an inclined position; means mounting the bottom portion to the back portion along adjacent edges thereof for relative pivotal movement therebetween; first roller and track means adapted to support the bottom portion on the frame structure at a forward portion thereof for substantially horizontal translational movement of the bottom portion relative to the frame structure; second roller and track means adapted to support the back position on the frame structure for movement from an upright position to a reclining position; third roller and track means having a roller mounted on each side of the seat member substantially coincident with the mounting means and a substantially horizontal track mounted on the frame structure upon which the third rollers are supported for movement therealong; first limiting means secured to the back portion at an upper end of the second track means for stopping the movement of the second roller means when the seat member is in the inclined position; second limiting means secured to the back portion adjacent a lower end of the second track means for stopping movement of the second roller means when the seat member is in the upright position; and spring means secured to the lower end of the second track means for releasably retaining the second roller means against the second limiting means and having a pillow means movably associated with an upper portion of the back portion of the seat member and having a pillow; a counterweight member; flexible means connecting the pillow to the counterweight member and disposed over the upper portion of the back portion of the seat member so that the pillow is disposed on a front side of the back portion and the counterweight member is disposed on a rear side of the back portion; and sheath means secured to the rear side of the back portion and containing the counterweight member therein so as to permit movement of the counterweight member in the sheath member in response to up and down movement of the pillow on the front side of the back portion of the seat member.

3. An adjustable recliner chair comprising: a rigid frame structure; a seat member having a bottom and a back portion, movable between an upright position and an inclined position; means mounting the bottom portion to the back portion along adjacent edges thereof for relative pivotal movement therebetween; first roller and track means adapted to support the bottom portion on the frame structure at a forward portion thereof for substantially horizontal translational movement of the bottom portion relative to the frame structure, said first roller means being attached to said rigid frame structure; second roller and track means adapted to support the back portion on the frame structure for movement from an upright position to a reclining position, said second roller means being attached to said rigid frame structure; third roller and track means having a roller mounted on each side of the seat member substantially coincident with the mounting means and a substantially horizontal track mounted on the frame structure upon which the third rollers are supported for movement therealong; said frame structure including a pair of side frames positioned on each side of said chair, each of said side frames including at least one cross member, said third track means including at least a portion of the upper surface of said cross member in said pair of side frames; said track means being secured to the back portion of said chair and including first and second limiting means for respectively stopping movement of the seat member at its fully inclined and its full upright positions, said first limiting means being formed from a bent portion within and at the upper end of said second track means so as to come into contact with said second roller means thereby stopping the movement of the seat member when in the fully inclined position; said second limiting means being formed from a bent portion within and at the lower end of said second track means said second limiting means being shaped so as to receive said second roller means therein thereby stopping movement of the seat member in the upright position; and spring means secured to the lower end of the second track means for releasably retaining the second roller means in contact with said second limiting means.

4. A recliner chair as defined in claim 3 wherein the means mounting is a hinge member extending substantially across upper adjacent edges of the bottom and back portions.

5. A recliner chair as defined in claim 3 wherein the first roller and track means comprises:

first rollers, one secured to each side of the frame structure adjacent the front portion of the bottom portion of the seat member; and first tracks, one secured to the under side of each side of the front portion of the bottom portion and associated with and supported by the first rollers for movement thereon when the seat member moves between the upright position and the inclined position.

6. A recliner chair as defined in claim 5 wherein the second roller and track means comprises:

second rollers, one secured to each side of the frame structure adjacent the rear side of the back portion of the seat member; and second tracks, one secured to each side of the rear side of the back portion of the seat member and associated with and supported by the second rollers for movement thereon when the seat member moves between the upright position and the inclined position.

7. A recliner chair as defined in claim 6 wherein the first limiting means comprises a bent upper portion of each of the second tracks which extends substantially perpendicular to the tracks and contacts the roller and prevents further movement of the second rollers beyond the inclined position of the seat member.

8. A recliner chair as defined in claim 7 wherein the second limiting means comprises a U-shaped portion of the lower end of each of the second tracks which opens in the upward direction to receive the second rollers therein and prevent further movement of the second rollers beyond the upright position of the seat member.

9. A recliner chair as defined in claim 3 in combination with an ottoman having an upper cushion portion moveable between first position which corresponds to the height of the front portion of the bottom portion of the seat member when the seat member is in the upright position and a second position which corresponds to the height of the front portion of the bottom portion of the seat member when the seat member is in the inclined position.

* * * * *